US006860436B2

(12) United States Patent
Garcia et al.

(10) Patent No.: US 6,860,436 B2
(45) Date of Patent: Mar. 1, 2005

(54) FLUID PRODUCT DISPENSER

(75) Inventors: Firmin Garcia, Evreux (FR); Aline Abergel, Boulogne-Billancourt (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/451,115

(22) PCT Filed: Dec. 13, 2001

(86) PCT No.: PCT/FR01/03984

§ 371 (c)(1),
(2), (4) Date: Sep. 11, 2003

(87) PCT Pub. No.: WO02/49937

PCT Pub. Date: Jun. 27, 2002

(65) Prior Publication Data

US 2004/0050981 A1 Mar. 18, 2004

(30) Foreign Application Priority Data

Dec. 20, 2000 (FR) ..... 00 16697

(51) Int. Cl.[7] ..... B65D 1/32

(52) U.S. Cl. ..... 239/327; 239/309; 239/589; 239/596; 222/215; 222/633

(58) Field of Search ..... 239/327, 309, 239/589, 596, 602, DIG. 12; 222/107, 206, 215, 630–633; 422/120, 124, 305

(56) References Cited

U.S. PATENT DOCUMENTS

| | | | | |
|---|---|---|---|---|
| 2,947,415 A | | 8/1960 | Garth | |
| 3,412,907 A | * | 11/1968 | Faso | 222/215 |
| 3,897,005 A | | 7/1975 | Reiner | |
| 4,858,831 A | * | 8/1989 | Spector | 239/327 |
| 4,869,407 A | * | 9/1989 | Booth et al. | 239/327 |
| 6,254,836 B1 | * | 7/2001 | Fry | 422/124 |

FOREIGN PATENT DOCUMENTS

| | | |
|---|---|---|
| FR | 2 781 770 A | 2/2000 |
| WO | 2 778 639 A | 11/1999 |
| WO | WO 00 59800 A | 10/2000 |

OTHER PUBLICATIONS

Translation of International Preliminary Examination Report for PCT/FR01/03984 dated Sep. 26, 2002.

* cited by examiner

*Primary Examiner*—Steven J. Ganey
(74) *Attorney, Agent, or Firm*—Sughrue Mion, PLLC

(57) ABSTRACT

A fluid dispenser comprising: two sheets (1, 1'), at least one of which is deformable, the two sheets forming a fluid reservoir (15) between them, said at least one deformable sheet defining a deformable actuating wall so as to reduce the volume of the reservoir, the reservoir (15) advantageously being provided with resilient means (4) urging the reservoir towards its maximum volume; and a dispensing piece (2) fixed in leaktight manner between the two sheets (1, 1') and defining a dispensing orifice (24) via which the fluid from the reservoir is dispensed; said fluid dispensing being characterized in that the reservoir (15) is defined by an inner first sealing line (12) and the outer peripheral edges of the sheets are sealed together along an outer second sealing line (10) which surrounds the inner first sealing line, the two sealing lines (10, 12) defining between them at least one non-sealed-together zone (11) in which the sheets are not sealed together.

10 Claims, 3 Drawing Sheets

FLUID PRODUCT DISPENSER

The present invention relates to a fluid dispenser comprising two sheets forming a fluid reservoir between them. At least one of the sheets defines a deformable actuating wall which can be pressed to reduce the volume of the reservoir. The reservoir can further advantageously be provided with resilient means such as a spring urging the reservoir towards its maximum volume. In addition to the two sheets, the fluid dispenser further comprises a dispensing piece which is fixed in leaktight manner between the two sheets and which defines a dispensing orifice via which the fluid from the reservoir is dispensed by pressing on the deformable actuating wall. More simply, it is possible to say that such a fluid dispenser comprises two sheets forming a reservoir that can be compressed to deliver the fluid it contains through a dispensing orifice formed by a piece fixed between the two sheets.

Such a dispenser is described in particular in Document WO 00/59800. In the dispenser in that document, a removable closure element is provided that closes off the dispensing orifice. In the initial state, the removable closure element closes off the dispensing orifice and the reservoir is substantially flat so as to define a minimum volume substantially containing the fluid only. The resilient means contained inside the reservoir are then fully stressed so that the dispenser is in a configuration that is very flat. When the removable closure element is removed, air penetrates into the reservoir through the dispensing orifice, thereby. enabling the resilient means to relax inside the reservoir which then takes up a rest configuration in which it defines a maximum volume. By deforming the reservoir in this way by pressing on the actuating wall, it is possible to deliver through the dispensing orifice a two-phase mixture of the fluid and of air with excellent spraying quality.

An object of the present invention is to improve such a fluid dispenser as defined in the above-mentioned document. A particular object of the present invention is to improve the aesthetic appearance and the operating characteristics of the reservoir and of the dispensing piece.

In order to improve the way in which the reservoir and its periphery are formed, provision is made for the reservoir to be defined by an inner first sealing line and for the outer peripheral edges of the sheets to be sealed together along an outer second sealing line which surrounds the inner first sealing line, the two sealing lines defining between them at least one non-sealed-together zone in which the sheets are not sealed together. There is thus a double sealing line which guarantees that no fluid can leak out between the two sheets. In addition, the two concentric sealing lines ensure that the peripheral margin of the dispenser around the reservoir is entirely plane. The entirely flat peripheral margin is useful for affixing indications such as the brand, the type and the use of the fluid contained in the dispenser. Advantageously, the two sealing lines meet at a plurality of points, e.g. at said dispensing piece, thereby defining between them a plurality of non-sealed-together zones.

According to another characteristic of the invention, the inner second sealing line defines a convergence line of the reservoir, which line extends towards said dispensing piece to cause the contents of the reservoir to converge towards the dispensing orifice. The two converging sealing lines make it possible to channel the pressurized air inside the reservoir when said reservoir is subject to deformation.

Advantageously, the first sealing line forms a spring-receiving recess in which the resilient means are received at least in part.

According to another characteristic of the invention, the two sheets are provided with a detachable closure tab situated in front of the dispensing piece at the dispensing orifice for isolating the reservoir from the outside before the dispenser is used. Advantageously, the closure tab is formed by a portion of the sealed-together sheets, and has a leaktight sheet-piece-sheet point of contact on either side of the dispensing orifice. By providing such a point of contact on either side of the dispensing orifice, it is guaranteed that the dispensing orifice is not closed off by one of the two sheets being accidentally sealed over the dispensing orifice. Thus, the two sealed-together sheets forming the detachable closure tab form a non-sealed-together space situated in front of and around the dispensing orifice. The term "sheet-piece-sheet point of contact" is used to designate a place where the two sheets and the piece meet, with the piece interposed between the two sheets so as to have a Y-shaped contact configuration.

In another aspect of the invention, the dispensing piece has a front face forming the dispensing orifice, two sides, and a rear face facing the reservoir, said rear face forming a recess in which a piece of porous material is inserted, said recess having an end-wall in which the dispensing orifice is formed, and the piece of porous material extending from said end-wall into the reservoir so that it can be soaked with fluid, the rear face forming a convergence wall on either side of the recess, which wall extends towards the recess, the piece of porous material comprising a head engaged in the recess and a body extending in the reservoir, the body forming a guide wall extending towards the head on either side of the head, each guide wall extending substantially parallel to a respective one of the convergence walls of the dispensing piece so as to form between them two convergence and guide channels for directing the contents of the reservoir towards the dispensing orifice.

The convergence and guide channels end directly at the head of the piece of porous material, and thus directly in the vicinity of the dispensing orifice. It is thus guaranteed that an excellent mixture of air and of the fluid is achieved, thereby contributing to improving the quality of spraying at the outlet of the dispensing orifice. The two convergence walls, which are situated substantially in alignment with the convergence lines formed by the reservoir also serve to guide the pressurized air in the reservoir towards the dispensing orifice.

In another aspect of the invention, the sides of the dispensing piece have tapered thin edges at which the sealed-together sheets are in leaktight sheet-piece-sheet contact. Excellent leaktightness is thus provided where the two sealed-together sheets meet the dispensing piece.

According to another characteristic of the invention, the front face comprises:

a dispensing wall that is substantially perpendicular to the axis along which the dispensing orifice extends and in which the dispensing orifice is formed; and tapered thin edges on either side of the dispensing wall and at which the sealed-together sheets are in leaktight sheet-piece-sheet contact.

The two sealed-together sheets that extend at the front face of the dispensing piece form the above-defined removable closure tab.

In order to be used as a sample that can be inserted into magazines, the dispensing piece has a thickness of less than about 2 millimeters (mm), so that, before it has been used, the dispenser has a thickness of less then about 2 mm.

It should be noted that most of the above-mentioned characteristics may be implemented separately in any given fluid dispenser. For example, the double sealing line implemented at the two sheets does not necessarily have to be combined with a dispensing piece forming convergence and guide channels. Similarly, a removable closure element having two sheet-piece-sheet points of leaktightness may be implemented with a fluid dispenser that does not incorporate a piece of porous material. These examples are non-limiting examples.

The invention is described more fully below with reference to the accompanying drawings given by way of non-limiting example and showing an embodiment of the invention.

Figure 1:
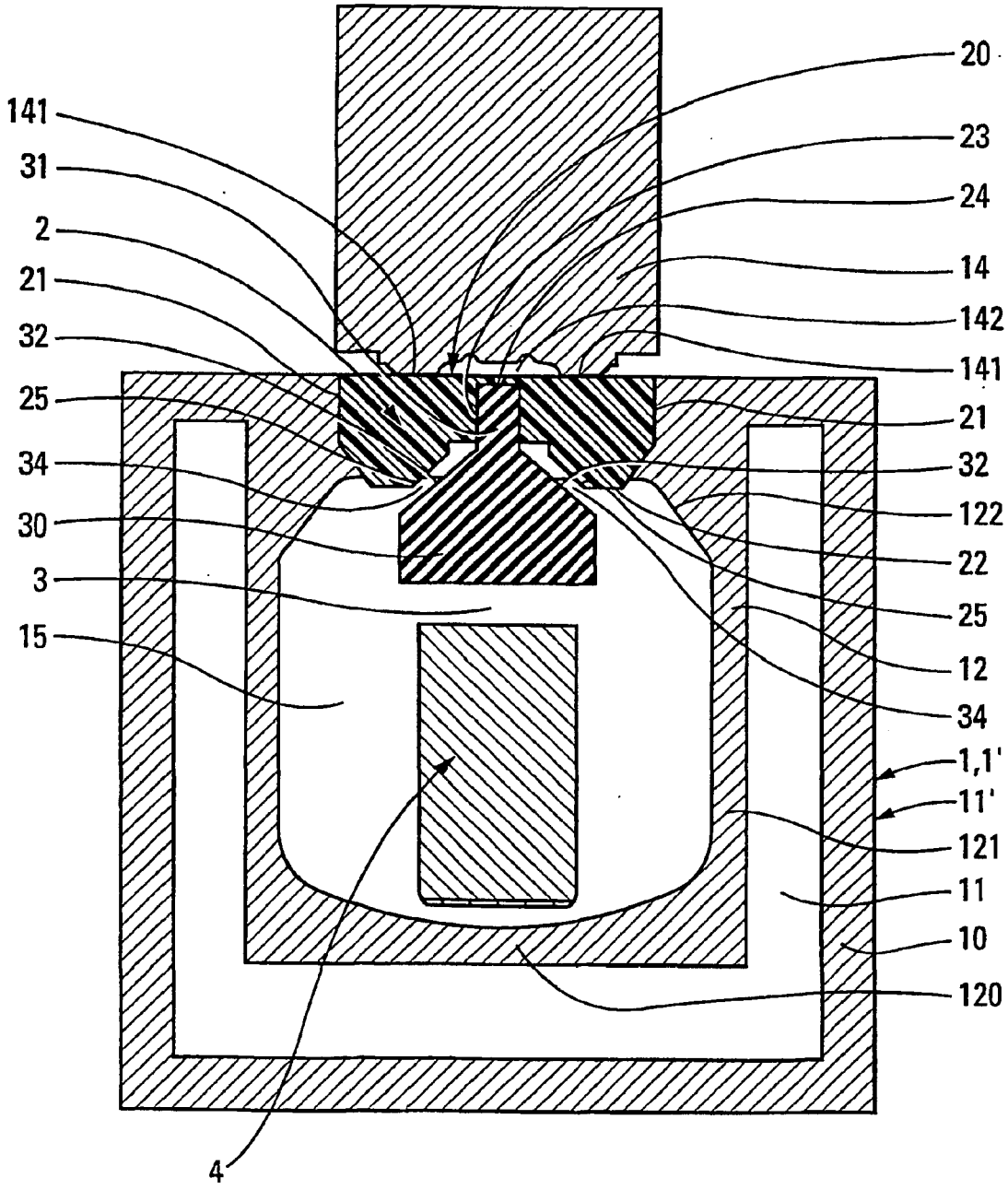
FIG. 1 is a plan view of a fluid dispenser of the invention.
Figure 2:
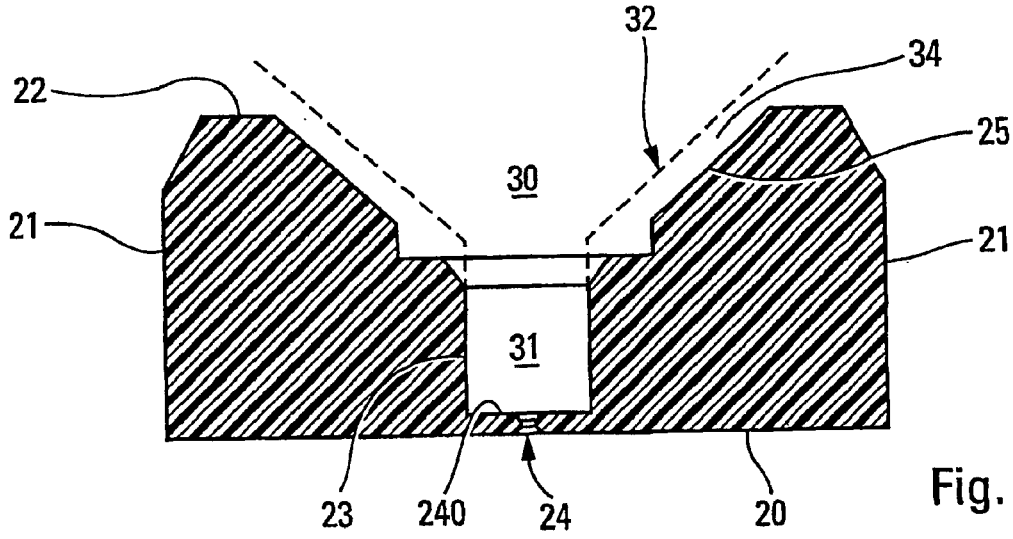
FIG. 2 is a horizontal section view through a dispensing piece of the invention.
Figure 6:
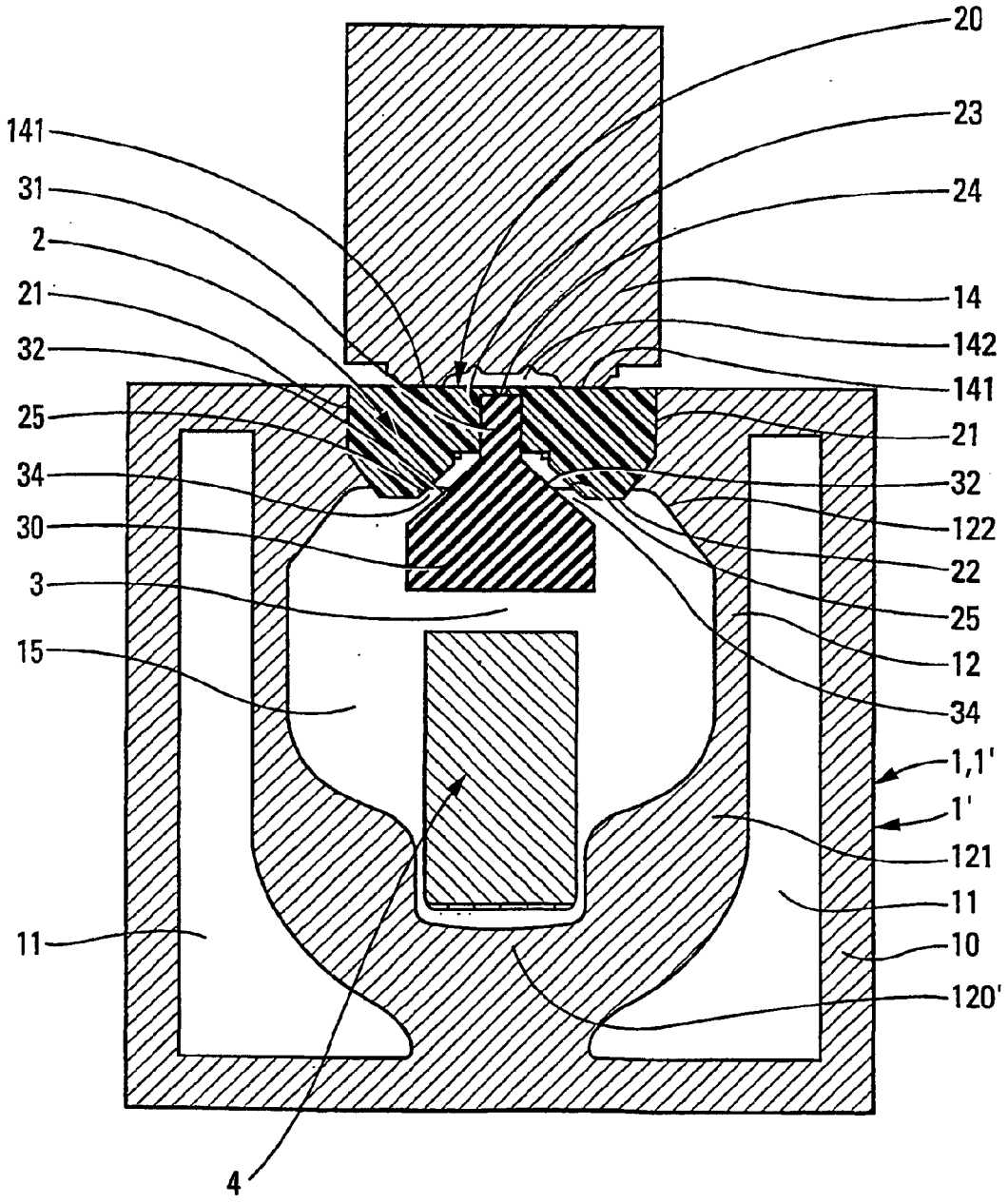
FIG. 6 is a view similar to the FIG. 1 view for a second embodiment of the invention.

In the examples of FIGS. 1 and 6, the fluid dispenser comprises five component elements, namely two sheets 1, 1', a dispensing piece 2, a piece of porous material 3, and a spring 4.

The two sheets 1, 1' may be entirely identical, and made from a laminated film, e.g. a plastic-metal-plastic film. In which case, the two sheets are deformable. It is also possible to imagine other embodiments in which only one of the sheets is deformable while the other sheet is substantially or completely rigid. It is even possible to imagine one sheet in the form of a substrate and the other sheet in the form of a shaped shell. However, in the present example, both sheets are deformable and identical.

The two sheets 1, 1' together form a body 11' which is square in shape in this example, and which underlies a closure element 14. The closure element 14 is also square or rectangular in shape, but of small size. It is also possible to imagine other embodiments in which the body is round, oval, or of even more complex geometrical shape with a closure element also having a complex shape.

The two sheets 1, 1' are sealed together over various zones. They are then sealed together around the periphery of the body 11' along a first sealing line 10 which extends around almost the entire periphery of the body 11'. The two sheets 1, 1' are also sealed together along a second sealing line 12 which is surrounded by the first sealing line 10 and which is connected thereto over one side of the body 11'. The two sealing lines 10 and 22 define one or more non-sealed-together zones 11. In FIG. 1, there is a single U-shaped zone which surrounds the second sealing line 12. This non-sealed-together zone 11 is entirely plane because it is completely surrounded by sealing lines.

The second sealing line 12 defines a reservoir 15 formed with a bottom 120 and side walls 121. At its top end, the reservoir 15 is closed off by a dispensing piece 2 which is sealed between the two sheets 1, 1' substantially where the first and second sealing lines 10 and 12 meet. The reservoir 15 contains fluid, advantageously a small quantity of fluid, and a spring 4 which serves to space the two sheets 1, 1' apart at the reservoir 15, thereby defining an internal volume which is the working volume of the reservoir 15. Naturally, it is possible to imagine other embodiments, e.g. using a shaped shell in place of one of the sheets: in which case, the function of the spring 4 can be integrated directly into the actuating wall of the shaped shell by imparting a shape memory characteristic to it. In the embodiment shown in FIG. 6, the sealing lines 10 and 12 meet on either side of the dispensing piece 2, as shown in FIG. 1, but also at the bottom of the reservoir, which bottom advantageously forms a recess 120' in which the bottom portion of the spring 4 is received so as to hold it in position in the reservoir. The sealing lines 10 and 12 thus define two non-sealed-together zones 11 that are entirely plane and that extend substantially laterally on either side of the reservoir 15.

The reservoir 15 also contains a piece of porous material 3 which is secured to the dispensing piece 2. The piece of porous material 3 is formed with a body 30 which extends inside the reservoir 15 and with a head 31 which serves as an end-piece for fixing into a recess 23 formed by the dispensing piece 2. The recess 23 has an end-wall 240 in which a dispensing orifice 24 is formed through which the fluid and the air contained in the reservoir 15 are delivered under pressure so as to form a two-phase sprayed jet made up of the fluid and of air at the outlet of the dispensing orifice 24. For example, the head 31 of the piece of porous material 3 may be engaged by force into the recess 23 so that the end of the head reaches the level of the dispensing orifice 24 as can be seen in FIG. 1. The recess 23 for the head 31 of the piece of porous material 3 is formed in the rear face of the dispensing piece 2. Said rear face 22 also forms two convergence walls 25 that extend towards the recess 23. In addition, the body 30 of the piece of porous material 3 also forms two guide walls 32 that extend towards the head 31. Each guide wall 32 extends substantially parallel to a respective convergence wall 25 of the dispensing piece 2 so as to form between them two convergence and guide channels 34 that make it possible to direct the contents of the reservoir 15 towards the dispensing orifice 24. The ends of the two channels 34 terminate at the level of the head 31 of the piece of porous material, i.e. in the immediate vicinity of the dispensing orifice 24. However, the air directed along the channels 34 must pass through the piece of porous material 3 which is soaked with the fluid.

In order to improve the convergence of the air towards the dispensing orifice 24, the second sealing line 12 defining the reservoir 15 also forms convergence lines 122 at the top ends of the side walls 121, which lines also converge towards the dispensing orifice 24, substantially in alignment with the above-mentioned convergence walls 25 and guide walls 32. Thus, the reservoir, the dispensing piece, and the piece of porous material 3 are all shaped to improve and to facilitate channeling the compressed air towards the dispensing orifice 24.

Figure 3:
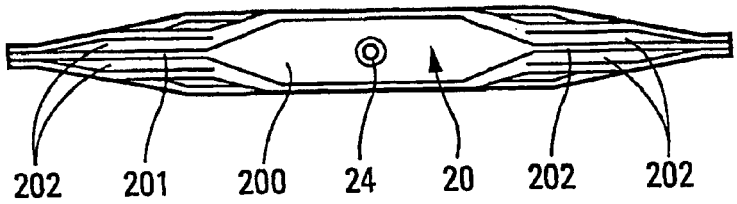
FIG. 3 is a front view of the dispensing piece of FIG. 2.
Figure 4:
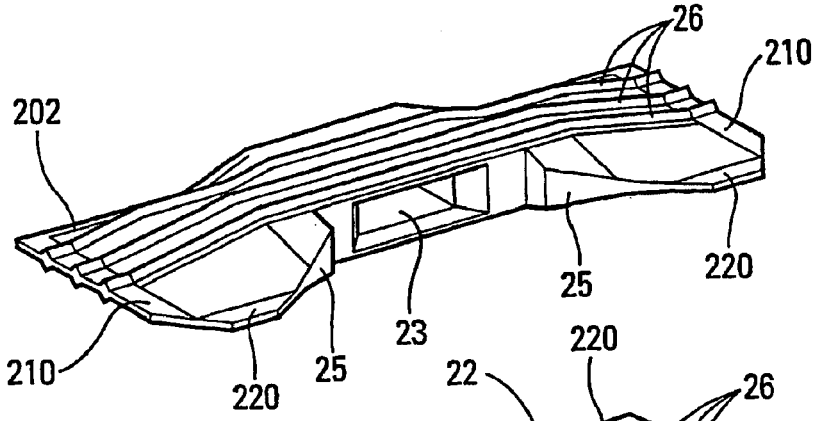
FIG. 4 is a perspective view seen looking from the rear of the dispensing piece of FIGS. 2 and 3.
Figure 5:
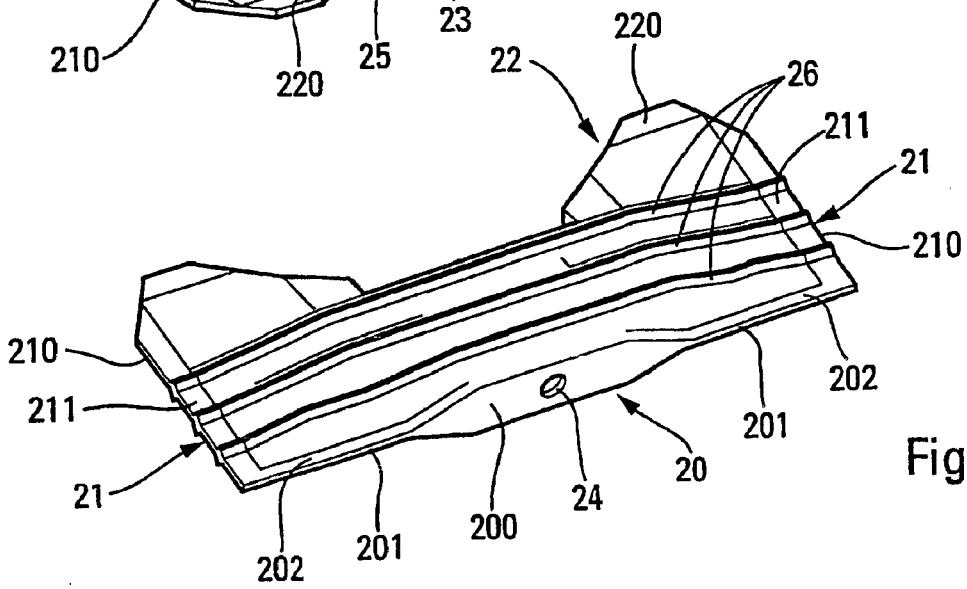
FIG. 5 is a perspective view seen looking from above and from the front of the dispensing piece of FIGS. 2 to 4.

With reference more particularly to FIGS. 3 to 5, it is possible to see that, in addition to the rear face 22, the dispensing piece 2 also forms side faces 21 and a front face 20. The front face 20, in which the dispensing orifice 24 is formed has a dispensing wall 200 which extends substantially perpendicularly to the axis along which the dispensing orifice 24 extends the dispensing orifice 24 is formed substantially in the center of said dispensing wall 200. On either side of the dispensing wall 200, the front face forms two tapered thin edges 201. The tapered thin edges 201 define substantially flat margins 202 on either side. The two side edges 21 are formed similarly with tapered thin edges 210 defining flat margins 211 on either side. A portion of the rear face is formed similarly with flat margins 220. The flat margins 202, 211, and 220 extend around the periphery of the dispensing piece except at the dispensing wall 200 and at the recess 23. The flat margins form the edges of respective ones of the top and bottom surfaces of the dispensing piece 2. It can be noted that the dispensing piece is particularly flat, and preferably of thickness substantially equal to 2 mm. On the top and bottom surface, the dispensing piece also forms sealing ribs 26 which serve to melt at least in part while the dispensing piece is being sealed between the two sheets 1 and 1'. In the invention, the tapered thin edges 201, 211 and 220 formed on the periphery of the dispensing piece make it possible to obtain leaktight sealing with the sheets 1 and 1' where the two sheets meet again, i.e. at the sheet-piece-sheet point of contact. By making the periphery of the dispensing piece particularly thin where the sheets 1, 1' are sealed to it, the sheets can join together more easily after the region in which they are in contact with the dispensing piece. Properly leaktight sealing is thus obtained.

It should be noted that the dispensing piece defines tapered thin edges 201 at its front face but not at the dispensing orifice 24 where the front face defines the dispensing wall 200. The tapered edges 201 situated on either side of the dispensing orifice 24 make it possible to implement two leaktight sheet-piece-sheet points of contact beyond which the two sealed-together sheets 1, 1' form the removable closure element 14. The two leaktight points of contact 141 (shown in FIG. 1) are separated by a non-sealed-together zone 142 into which the dispensing orifice 24 opens out. The non-sealed-together gap 142 extends substantially at the dispensing wall 200 and ends at the starts of the tapered thin edges 201. It is thus guaranteed that no sheet is sealed to the dispensing orifice 24, and that, by tearing off the removable closure element 14, the dispensing orifice 24 is unmasked.

Such a fluid dispenser is easy to use. Before the dispenser has been used, it is entirely flat, since its thickness is defined by the thickness of the dispensing piece 2 which is preferably no larger than 2 mm. The spring 4 is completely stressed, and the reservoir 15 contains substantially fluid only. When the user wants to use said dispenser, the user starts by tearing off the removable closure element 14 that until then isolated the dispensing orifice 24 from the outside. Tearing off the element 14 makes it possible for air to enter the reservoir 15 via the dispensing orifice 24. The reservoir then takes up its maximum volume as urged by the spring 4. It is then necessary for the user merely to press on the reservoir 15 so as to stress the spring 4, thereby reducing the volume of the reservoir. The air contained inside the reservoir is then put under pressure, and is constrained to pass through the piece of porous material 3 to the dispensing orifice 24, where the fluid is sprayed with the pressurized air.

What is claimed is:

1. A fluid dispenser comprising:

two sheets (1, 1'), at least one of which is deformable, the two sheets forming a fluid reservoir (15) between them, said at least one deformable sheet defining a deformable actuating wall so as to reduce the volume of the reservoir, the reservoir (15) being provided with resilient means (4) urging the reservoir towards its maximum volume; and a dispensing piece (2) fixed in leaktight manner between the two sheets (1, 1') and defining a dispensing orifice (24) via which the fluid from the reservoir is dispensed;

said fluid dispensing being characterized in that the reservoir (15) is defined by an inner first sealing line (12) and the outer peripheral edges of the sheets are sealed together along an outer second sealing line (10) which surrounds the inner first sealing line, the two sealing lines (10, 12) defining between them at least one non-sealed-together zone (11) in which the sheets are not sealed together.

2. A dispenser according to claim 1, in which the two sealing lines (10, 12) meet at a plurality of points, thereby defining between them a plurality of non-sealed-together zones (11).

3. A dispenser according to claim 1, in which the two sealing lines (10, 12) meet at said dispensing piece (2).

4. A dispenser according to claim 1, in which the inner first sealing line (12) defines a convergence line (122) of the reservoir, which line extends towards said dispensing piece (2) to cause the contents of the reservoir (15) to converge towards the dispensing orifice.

5. A dispenser according to claim 1, in which the two sheets (1, 1') are provided with a detachable closure tab (14) situated in front of the dispensing piece (2) at the dispensing orifice (24) for isolating the reservoir (15) from the outside before the dispenser is used.

6. A dispenser according to claim 5, in which the closure tab (14) is formed by a portion of the sealed-together sheets, and has a leaktight sheet-piece-sheet point of contact (141) on either side of the dispensing orifice.

7. A dispenser according to claim 1, in which the dispensing piece has:

a front face (20) forming the dispensing orifice (24);

two sides (21); and a rear face (22) facing the reservoir (15), said rear face (22) forming a recess (23) in which a piece of porous material (3) is inserted, said recess (23) having an end-wall (240) in which the dispensing orifice (24)is formed, and the piece of porous material (3) extending from said end-wall (240) into the reservoir (15) so that it can be soaked with fluid, the rear face (22) forming a convergence wall (25) on either side of the recess, which wall extends towards the recess (23), the piece of porous material (3) comprising a head (31) engaged in the recess (23) and a body (30) extending in the reservoir (15), the body (30) forming a guide wall (32) extending towards the head (31) on either side of the head, each guide wall (32) extending substantially parallel to a respective ones of the convergence walls (25) of the dispensing piece (2) so as to form between them two convergence and guide channels (34) for directing the contents of the reservoir (15) towards the dispensing orifice (24).

8. A dispenser according to claim 7, in which the sides (21) of the dispensing piece (2) have tapered thin edges (210) at which the sealed-together sheets (1, 1') are in leaktight sheet-piece-sheet contact.

9. A dispenser according to claim 7, in which the front face (20) comprises:

a dispensing wall (200) that is substantially perpendicular to the axis along which the dispensing orifice (24) extends and in which the dispensing orifice is formed; and tapered thin edges (201) on either side of the dispensing wall (200) and at which the sealed-together sheets are in leaktight sheet sheet-piece-sheet contact.

10. A dispenser according to claim 1, in which the first sealing line (12) forms a spring-receiving recess (120') in which the resilient means are received at least in part.

* * * * *